US005638904A

United States Patent [19]

Misselbrook et al.

[11] Patent Number: 5,638,904

[45] Date of Patent: Jun. 17, 1997

[54] SAFEGUARDED METHOD AND APPARATUS FOR FLUID COMMUNICTION USING COILED TUBING, WITH APPLICATION TO DRILL STEM TESTING

[75] Inventors: John G. Misselbrook; David E. Sask, both of Calgary, Canada

[73] Assignee: Nowsco Well Service Ltd., Calgary, Canada

[21] Appl. No.: 564,355

[22] PCT Filed: Jul. 25, 1995

[86] PCT No.: PCT/US95/10007

§ 371 Date: Mar. 19, 1996

§ 102(e) Date: Mar. 19, 1996

[51] Int. Cl.[6] ..... E21B 19/08

[52] U.S. Cl. ..... 166/384; 166/77.2

[58] Field of Search ..... 166/384, 385, 166/379, 380, 77.2, 77.3

[56] References Cited

U.S. PATENT DOCUMENTS

| | | |
|---|---|---|
| 2,832,374 | 4/1958 | November . |
| 3,076,760 | 2/1963 | Markham . |
| 3,083,158 | 3/1963 | Markham . |
| 3,681,240 | 8/1972 | Fast et al. . |
| 4,073,344 | 2/1978 | Hall . |
| 4,167,111 | 9/1979 | Spuck . |
| 4,248,298 | 2/1981 | Lamers . |
| 4,442,014 | 4/1984 | Looney . |
| 4,663,059 | 5/1987 | Ford . |
| 4,698,168 | 10/1987 | Briggs . |
| 4,823,874 | 4/1989 | Ford . |
| 4,898,236 | 2/1990 | Sask . |
| 4,979,563 | 12/1990 | Patel . |
| 4,995,462 | 2/1991 | Grimshaw et al. . |
| 5,034,140 | 7/1991 | Gardner et al. . |
| 5,287,741 | 2/1994 | Schultz et al. . |
| 5,348,097 | 9/1994 | Giannesini . |
| 5,351,533 | 10/1994 | Macadam et al. . |
| 5,353,875 | 10/1994 | Schultz et al. . |
| 5,411,105 | 5/1995 | Gray . |
| 5,435,395 | 7/1995 | Connell . |
| 5,503,014 | 4/1996 | Griffith . |

FOREIGN PATENT DOCUMENTS

| | | |
|---|---|---|
| 852553 | 9/1970 | Canada . |
| 951258 | 7/1974 | Canada . |
| 1059430 | 7/1979 | Canada . |
| 1161697 | 2/1984 | Canada . |
| 1180957 | 1/1985 | Canada . |
| 1204634 | 5/1986 | Canada . |
| 2122770 | 1/1994 | Canada . |
| 2122852 | 5/1994 | Canada . |

OTHER PUBLICATIONS

PCT—International Search Report.

Article from *Oil & Gas Journal*, "Jet-assisted drilling nears commercial use", Mar. 11, 1991, by: Mike Cure & Pete Fontana.

Technical Paper—"Horizontal Wells—A New Method For Evaluation & Stimulation", By: Downhole Systems Technology Canada Inc. (Jun., 1994).

Technical Paper—"New Laboratory Procedures for Evaluation of Drilling Induced Formation Damage and Horizontal Well Performance", presented at the Canadian SPE/CIM/CANMET International Conference on Recent Advances in Horizontal Well Applications, by: Gruber & Adair Mar. 1994.

*Primary Examiner*—William P. Neuder

*Attorney, Agent, or Firm*—Sue Z. Shaper; Butler & Binion, L.L.P.

[57] ABSTRACT

A safeguarded method and apparatus for providing fluid communication with coiled tubing, said coiled tubing comprising more particularly coiled-in-coiled tubing, having a inner tube and an outer tube, and including multicentric coiled-in-coiled tubing and its method of assembly, the safeguarded method having particular applicability to drill stem testing.

46 Claims, 8 Drawing Sheets

FIG. 7
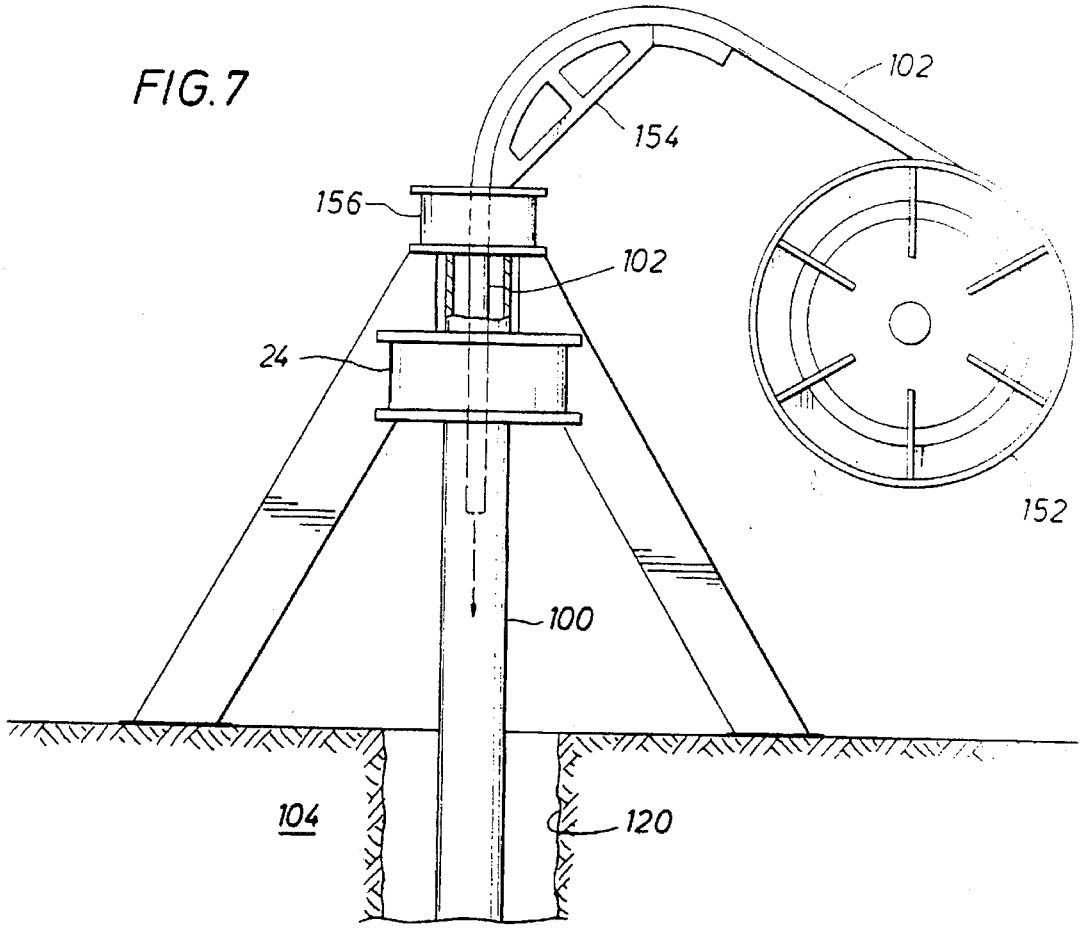
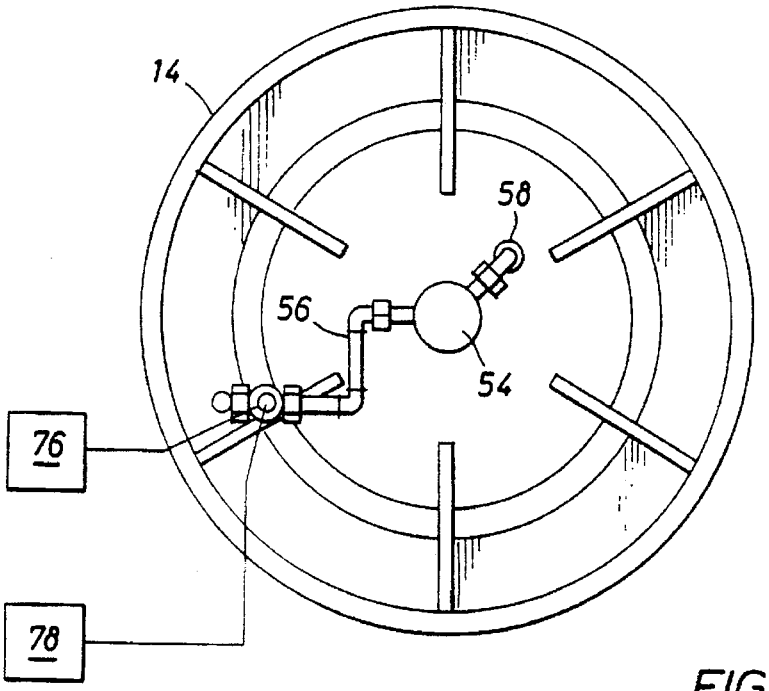
FIG. 2B

FIG. 8D
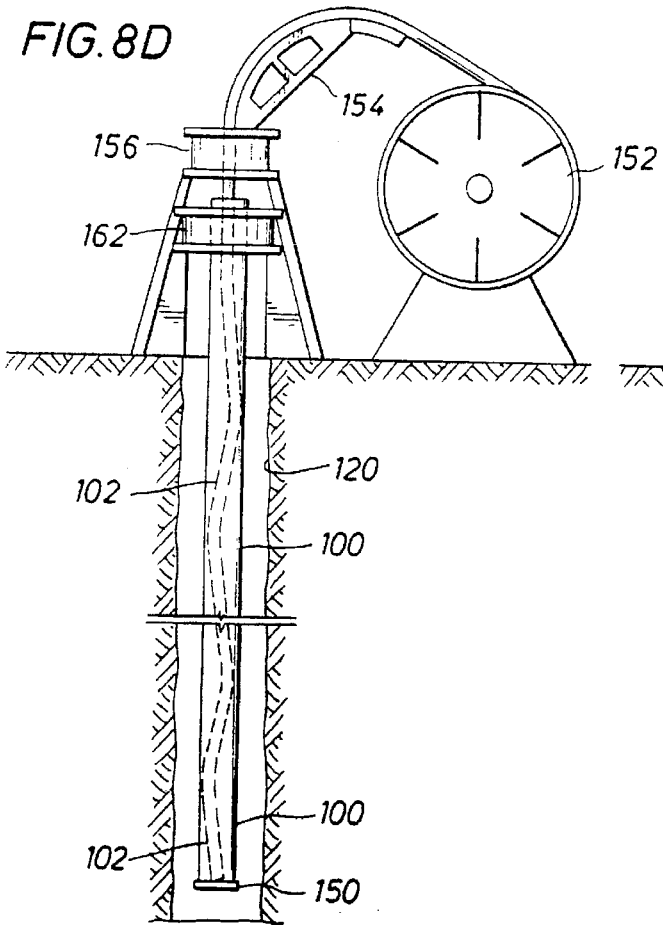
FIG. 8E
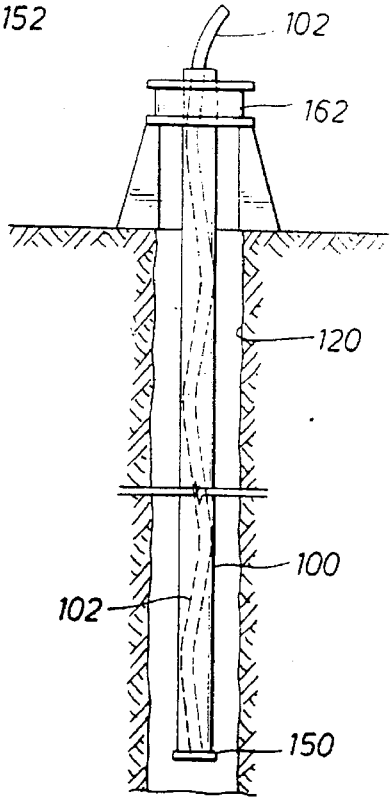
FIG. 8F
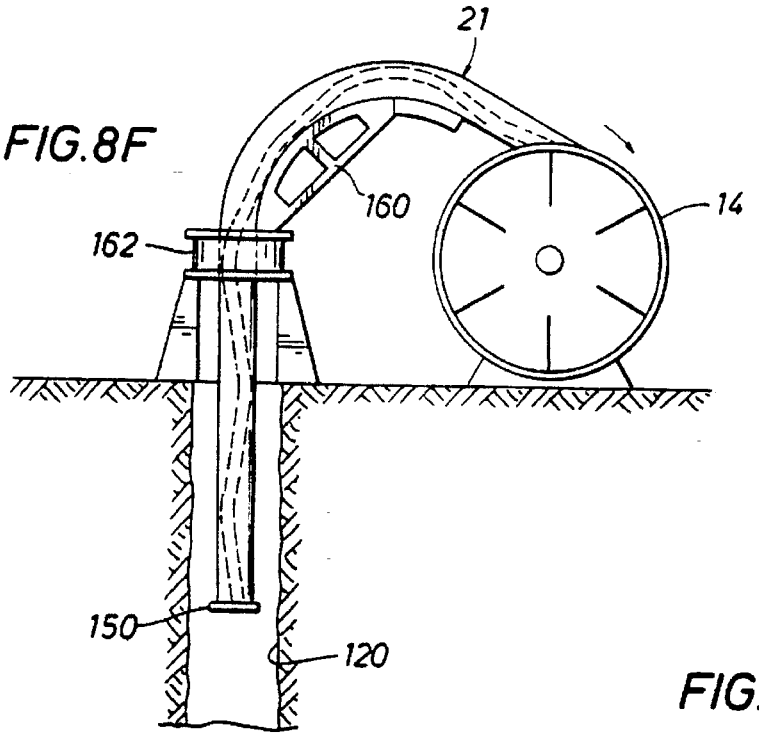
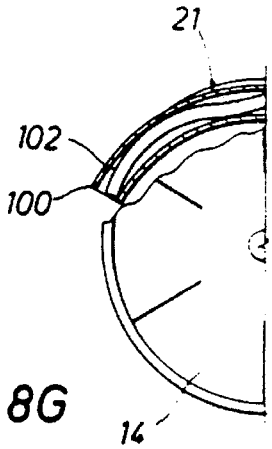
FIG. 8G

SAFEGUARDED METHOD AND APPARATUS FOR FLUID COMMUNICTION USING COILED TUBING, WITH APPLICATION TO DRILL STEM TESTING

FIELD OF INVENTION

This invention pertains to safeguarded methods and apparatus for providing fluid communication with coiled tubing, useful in communicating fluids within wells, and particularly applicable to drill stem testing and/or operations in sour wells. This invention also pertains to multicentric coiled-in-coiled tubing, useful for safeguarded downhole or conduit operations, and its method of assembly.

BACKGROUND OF INVENTION

The oil and gas industry uses various methods to test the productivity of wells prior to completing and tying a well into a pipeline or battery. After drilling operations have been completed and a well has been drilled to total depth ("TD"), or prior to reaching TD in the case of multi-zoned discoveries, it is common to perform a drill stem test ("DST"). This test estimates future production of oil or gas and can justify a further expenditure of capital to complete the well.

The decision to "case" a well to a particular depth, known as a "casing point election", can result in an expenditure in excess of $300,000. Without a DST, a wellsite geologist must make a casing point election based on only core samples, cuttings, well logs, or other indicators of pay thicknesses. In many cases reservoir factors that were not knowable at the time of first penetration of the producing zone, and thus not reflected in the samples, cuttings, etc., can control the ultimate production of a well. A wellsite geologist's problem is exacerbated if the well is exploratory, or a wildcat well, without the benefit of comparative adjacent well information. Further, the geologist must make a casing point election quickly as rig time is charged by the hour.

A DST comprises, thus, a valuable and commonly used method for determining the productivity of a well so that optimal information is available to the geologist to make a casing point election. Traditionally the DST process involves flowing a well through a length of drill pipe reinserted through the static drilling fluid. The bottom of the pipe will attach to a tool or device with openings through which well fluids can enter. This perforated section is placed across an anticipated producing formation and sealed off from the rest of the wellbore with packers, frequently a pair of packers placed both above and below the formation. The packer placement or packing off technique permits an operator to test only an isolated section or cumulative sections. The testing can involve actual production into surface containers or containment of the production fluid in the closed chamber comprised by the pipe, pressure testing, physically retrieving samples of well fluids from the formation level and/or other valuable measurements.

The native pressure in producing reservoirs is controlled during drilling through the use of a carefully weighted fluid, referred to above and commonly called "drilling mud". The "mud" is continuously circulated during the drilling to remove cuttings and to control the well should a pressurized zone be encountered. The mud is usually circulated down the inside of the drill pipe and up the annulus outside of the pipe and is typically made up using water or oil based liquid. The mud density is controlled through the use of various materials for the purpose of maintaining a desired hydrostatic pressure, usually in excess of the anticipated native reservoir pressure. Polymers and such are typically added to the mud to intentionally create a "filter cake" sheath-like barrier along the wellbore surface in order to staunch loss of over-pressured drilling fluid out into the formation.

As can be easily appreciated, when an upper packer of a DST tool seals an annular area between a test string and a borehole wall, the hydrostatic pressure from the column of drilling fluid is relieved on the wellbore below the packer. The well below the packer, thus, can flow if an open fluid communication channel exists to the surface. At least the well will flow to the extent that native pressure present at the open formation of the isolated section exceeds the hydrostatic head pressure of the fluids in the drill pipe. Such produced fluids that flow to or toward the surface are either trapped in the pipe string or collected in a container of known dimensions and/or flared off. By calculating the volume of actual fluid produced, after considering such factors as the time of the test and the size of the choke used, a reasonable estimate of the ultimate potential production capacity of a well can be made. Upon occasion formation pores are too clogged, as by the drilling fluid filter cake, to be overcome by formation pressure and flow. It may be desired in such cases to deliver a gas or an acid to the formation to stimulate flow.

Many wells throughout the world contain hydrogen sulfide gas ($H_2S$), also known as "sour gas". Hydrogen sulfide gas can be harmful to humans or livestock at very low concentrations in the atmosphere. In Alberta, Canada, sour wells commonly produce hydrocarbon fluids with concentrations of 2–4% $H_2S$ and often as high as 30–35% $H_2S$. These are among the most sour wells in the world. It is also known that sour gas can cause embrittlement of steel, such as the steel used in drill pipe. This is especially true when drill pipe contains hardened steel, which is commonly used to increase the life of the drill string. Due to a tendency for drill pipe to become embrittled when exposed to $H_2S$ and the possibly disastrous effect of sour gas in the atmosphere with its potential for environmental damage or injury to people or animals, it is extremely uncommon to perform drill stem tests on sour wells. Even a pin hole leak in a drill pipe used for such purposes could have deleterious results.

Unfortunately, many highly productive wells are very sour and found in exploratory areas. In some cases, oil companies have been prepared to go to the expense of temporarily completing a sour well by renting production tubing and hanging it in a well without cementing casing in place, just to effect a production test. This method, due to the increase in rig time, can cost in excess of $200,000, which could be greater than the cost of a completion in shallow wells.

Coiled tubing is now known to be useful for a myriad of oilfield exploration, testing and/or production related operations. The use of coiled tubing began more than two decades ago. In the years that have followed coiled tubing has evolved to meet exacting standards of performance and to become a reliable component in the oil and gas service industry. Coiled tubing is typically manufactured from strips of low alloy mild steel with a precision cut, and rolled and seam welded in a range of OD (outside diameter) sizes, envisioned to run up to 6 inches. Currently, OD sizes are available up to approximately 4 inches. Improvements in manufacturing technology have resulted in increased material strength and consistent material quality. Development of a "strip bias weld" has improved the reliability of factory made Joints in the coiled tubing string. Heat treatment and material changes have increased resistance of the tubing to $H_2S$ induced embrittlement and stress corrosion cracking that can incur in operations in sour environments. An increase in wall thickness and the development of higher strength alloys are also allowing the industry to increase the depth and pressure limits within which the tubing may be run. The introduction of new materials and structure, such as titanium and composite material tubing design, is also expected to further expand coiled tubing's scope of work.

Coiled tubing could be particularly valuable in sour or very sour wells due to coiled tubing's typically softer steel composition that is not so susceptible to hydrogen sulfide embrittlement. However, another factor inhibits producing sour gas or performing a DST in a sour well with coiled tubing. The repeated coiling and uncoiling of coiled tubing causes tubing walls, presently made of the steel, to plastically deform. Sooner or later the plastic deformation of the tubing wells is likely to cause a fracture. A resulting small pin hole leak or crack could produce emissions.

Oil and gas operations have known the use of concentric pipe strings. Concentric pipe strings provide two channels for fluid communication downhole, typically with one channel, such as the inner channel, used to pump fluid (liquid or gas or multiphase fluid) downhole while a second channel, such as the annular channel formed between the concentric strings, used to return fluid to the surface. (A further annulus created between the outer string and the casing or liner or wellbore could, of course, be used for further fluid communication). Which channel is used for which function can be a matter of design choice. Both concentric pipe channels could be used to pump up or down.

Concentric tubing utilizing coiled tubing, at least in part, has been proposed for use in some recent applications. Coiled tubing enjoys certain inherent advantages over jointed pipe, such as greater speed in running in and out of a well, greater flexibility for running in "live" wells and greater safety due to requiring less personnel to be present in high risk areas and the absence of joints and their inherent risk of leaks. Patterson in U.S. Pat. No. 4,744,420 teaches concentric tubing where the inner tubing member may be coiled tubing. It is inserted into an outer tubing member after that member has been lowered into the well bore. In Patterson the outer tubing member does not comprise coiled tubing. As FIG. 8 of Patterson illustrates, the inner tubing is secured within the outer tubing by spaced apart spoke-like braces or centralizers which hold the tubing members generally centered and coaxial. Sudol in U.S. Pat. No. 5,033,545 and Canadian Patent No. 1325969 discloses coaxially arranged endless inner and outer tubing strings. Sudol's coaxial composite can be stored on a truckable spool and run in or pulled out of a well by a tubing injector. Sudol's disclosure does not explicitly disclose how the coaxial tubing strings are maintained coaxial, but Sudol does show an understanding of the use of centralizers. U.S. Pat. No. 5,086,8422 to Cholet discloses an external pipe column 16 which is inserted into a main pipe column comprising a vertical section and a curved section. An internal pipe column is then lowered into the inside of the external pipe column. Cholet teaches that the pipe columns may be formed to be the rigid tubes screwed together or of continuous elements unwound from the surface. Cholet does not teach a single tubing composite that itself is wound on a spool, the composite itself comprising an inner tubing length and an outer tubing length. All of Cholet's drawings teach coaxial concentricity. U.S. Pat. No. 5,411,105 to Gray teaches drilling with coiled tubing wherein an inner tubing is attached to the reel shaft and extended through the coiled tubing to the drilling tool. Gas is supplied down the inner tube to permit underbalanced drilling. Gray, like Sudol, discloses coaxial tubing. Further, Gray does not teach a size for the inner tube or whether the inner tube comprises coiled tubing. A natural assumption would be, in Gray's operation, that the inner tube could comprise a small diameter flexible tube insertable by fluid into coiled tubing while on the spool, like wireline is presently inserted into coiled tubing while on the spool.

The present invention solves the problem of providing a safeguarded method for communicating potentially hazardous fluids and materials through coiled tubing. This safeguarded method is particularly applicable for producing and testing fluids from wells including very sour gas wells. The safeguarded method proposes the use of coiled-in-coiled tubing, comprising an inside coiled tubing length located within an outside coiled tubing length. Potentially hazardous fluid or material is communicated through the inside tubing length. The outside tubing length provides a backup protective layer. The outside tubing defines an annular region between the lengths that can be pressurized and/or monitored for a quick indication of any leak in either of the tubing lengths. Upon detection of a leak, fluid communication can be stopped, a well could be killed or shut in, or other measures could be taken before a fluid impermissibly contaminates its surroundings.

As an additional feature, the annular region between the tubing lengths can be used for circulating fluid down and flushing up the inside tubing, for providing stimulating fluid to a formation, for providing lift fluid to the inside tubing or for providing fluid to inflate packers located on an attached downhole device, etc.

The present invention also relates to the assembly of multicentric coiled-in-coiled tubing, the proposed structure offering a configuration and a method of improved or novel design. This improved or novel design provides advantages of efficient, effective assembly, longevity of use or enhanced longevity with use, and possibly enhanced structural strength.

SUMMARY OF THE INVENTION

This invention relates to the use of coiled-in-coiled tubing (several hundred feet of a smaller diameter inner coiled tube located within a larger diameter outer coiled tube) to provide a safeguarded method for fluid communication. The invention is particularly useful for well production and testing. The apparatus and method are of particular practical importance today for drill stem testing and other testing or production in potentially sour or very sour wells. The invention also relates to an improved "multicentric" coiled-in-coiled tubing design, and its method of assembly.

The use of two coiled tubing strings, one arranged inside the other, doubles the mechanical barriers to the outside environment. Fluid in the annulus between the strings can be monitored for leaks. To aid monitoring, the annular region between the coils can be filled with an inert gas, such as nitrogen, or a fluid such as water, mud or a combination thereof, and pressurized.

In one embodiment a fluid, such as water or an inert gas, can be placed in the annulus between the tubings and pressurized. This annular fluid can be pressurized to a greater pressure than either the pressure of the hazardous fluid being communicated via the innermost string or the pressure of the fluid surrounding the outer string, such as static drilling fluid. Because of this pressure differential, if a pin hole leak or a crack were to develop in either coiled tubing string the fluid in the annulus between the inner and outer string would flow outward through the hole. Instead of sour gas, for instance, potentially leaking out and contaminating the environment, the inner string fluid would be invaded by the annular fluid and continue to be contained in a closed system. An annular pressure gauge at the surface could be used to register pressure drop in annular fluid, indicating the presence of a leak.

Communicated fluids through the inner string could be left in the closed chamber comprised of the inner string, for one embodiment, or could be separately channeled from the coiled-in-coiled tubing at the spool or working reel. Separately channeled fluids could be measured, or fed into a flare at the surface or produced into a closed container, for other embodiments.

The coiled-in-coiled tubing should be coupled or attached to a device at its distal end to control fluids flowing through the inner tube. Fluid communications through the annular channel should also be controlled. At a minimum this control might comprise simply sealing off the annular region. For drill stem testing, packers and packing off techniques could be used in a similar fashion as with standard drill stem tests. An additional benefit is provided by the invention in that a downhole packer could be inflated with fluid supplied down the coiled-in-coiled tubing.

The inner coiled tube is envisioned to vary in size between ½" (inches) and 5½" (inches) in outside diameter ("OD"). The outer coiled tube can vary between 1" and 6" in outside diameter. A preferred size is 1 ¼ to 1 ½" O.D. for the inner tube and 2" to 2⅜" O.D. for the outer tube.

It is known that steel of a hardness of less than 22 on the Rockwell C hardness scale is suitable for sour gas uses. Coiled tubing can be commonly produced with a hardness of less than 22, being without the need for the strength required for standard drill pipe. Thus, coiled tubing is particularly fit for sour gas uses, including drill stem testing, as disclosed. Other materials such as titanium, corrosion resistant alloy (CRA) or fiber and resin composite could be used for coiled tubing. Alternately, other metals or elements could be added to coiled tubing during its fabrication to increase its life and/or usefulness.

BRIEF DESCRIPTION OF THE DRAWINGS

A better understanding of the present invention can be obtained when the following detailed description of the preferred embodiment is considered in conjunction with the following drawings, in which:

FIGS. 2A, 2B and 2C illustrate a working reel for coiled tubing with plumbing and fittings capable of supporting an inner coil with an outer coil.

FIG. 3 illustrates in cross-section an embodiment for separating or splitting inner and outer fluid communication channels into side-by-side fluid communication channels.

FIG. 4 illustrates in cross-section an inner and an outer coiled tubing section having a wireline within.

FIG. 7 illustrates an injection technique for injecting an inner coil within an outer coil to produce "multicentric" coiled-in-coiled tubing.

DETAILED DESCRIPTION OF THE PREFERRED EMBODIMENTS

Figure 1:
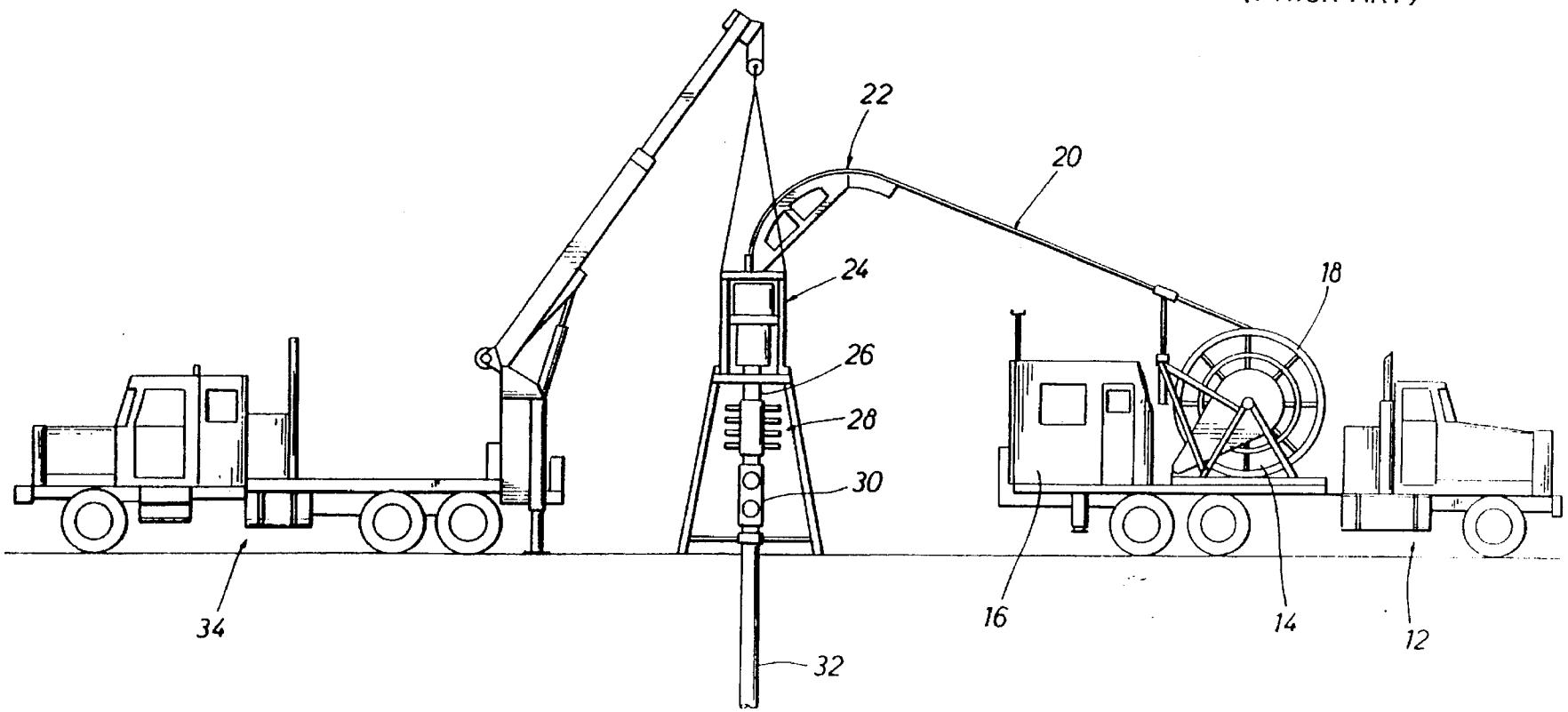
FIG. 1 (PRIOR ART)
FIG. 1 illustrates typical equipment used to inject coiled tubing into a well.

FIG. 1 illustrates a typical rigup for running coiled tubing. This rigup is known generally in the art. In this rigup truck 12 carries behind its cab a power pack including a hook-up to the truck motor or power take off, a hydraulic pump and an air compressor. The coiled tubing injecting operation can be run from control cab 16 located at the rear of truck 12. Control cab 16 comprises the operational center. Work reel 14 comprises the spool that carries the coiled tubing at the job site. Spool or reel 14 must be limited in its outside or drum or spool diameter so that, with a full load of coiled tubing wound thereon, the spool can be trucked over the highways and to a job site. A typical reel might offer a drum diameter of ten feet. Reel 14, as more fully explained in FIGS. 2 and 3, contains fixtures and plumbing and conduits to permit and/or control communication between the inside of the coiled tubing string and other instruments or tools or containers located on the surface.

FIG. 1 illustrates coiled tubing 20 injected over gooseneck guide 22 by means of injector 24 into surface casing 32. Injector 24 typically involves two hydraulic motors and two counter-rotating chains by means of which the injector grips the tubing and reels or unreels the tubing to and from the spool. Stripper 26 packs off between coiled tubing 20 and the wellbore. The well is illustrated as having a typical well christmas tree 30 and blowout preventor 28. Crain truck 34 provides lifting means for working at the well site.

Figure 2A:
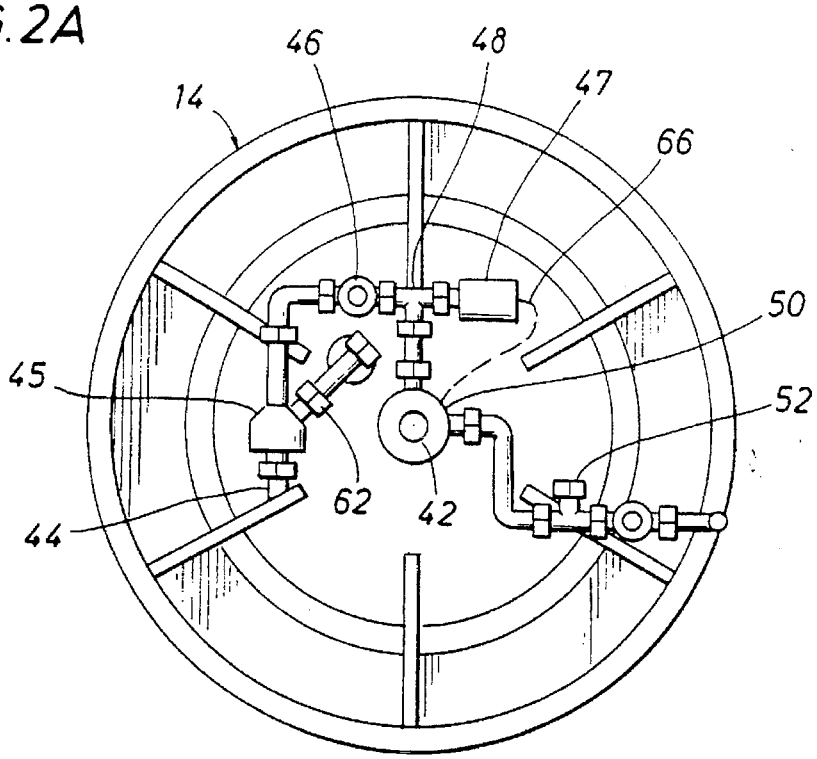
Figure 2C:
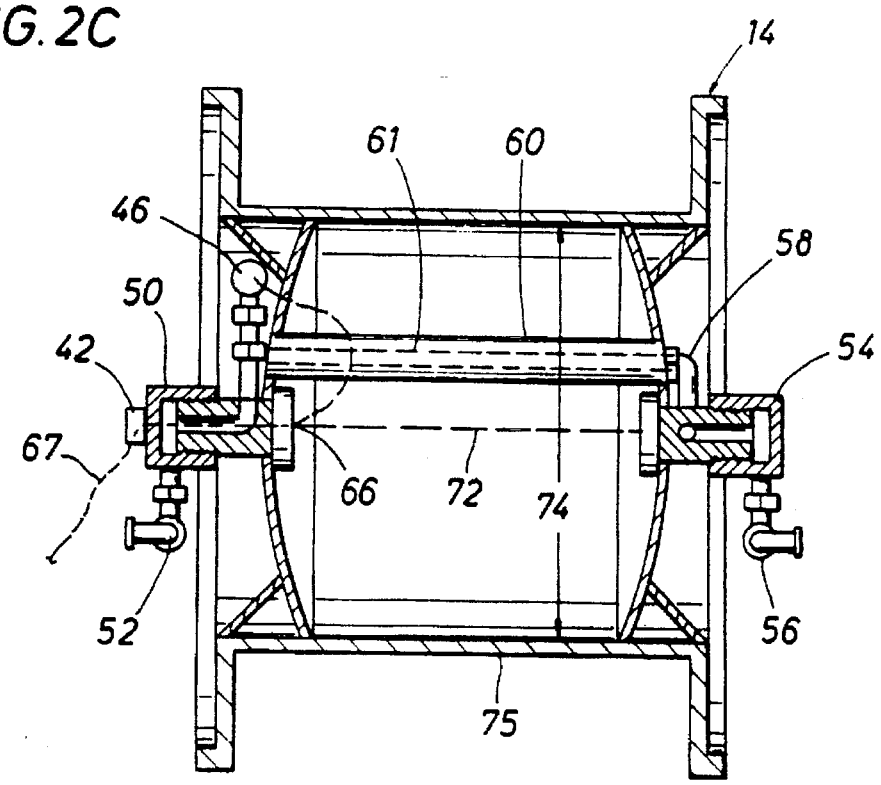

FIGS. 2A, 2B and 2C illustrate side views and a top cutaway view, respectively, of a working reel 14 fitted out for operating with coiled-in-coiled tubing.

FIG. 2A offers a first side view of working reel 14. This side view illustrates in particular the plumbing provided for the reel to manage fluid communication, as well as electrical communication, through the inner coiled tubing. The inner tubing is the tubing designated for carrying the fluid whose communication should be safeguarded, fluid that might be hazardous. The coiled-in-coiled tubing connects with working reel 14 through rotating connector 44 and fitting 45. Aspects of connector 44 and fitting 45 are more particularly illustrated in FIG. 3. This plumbing connection provides a lateral conduit 62 to channel fluid from the annular region between the two tubing lengths. Fluid communication through lateral conduit 62 proceeds through a central portion of reel 14 and a swivel joint on the far side of working reel 14. These connections are more particularly illustrated in FIGS. 2B and 2C, discussed below. Fluid from inside the inner coiled tubing, as well as wireline 66, communicate through high pressure split channel valve fixture 45 and into high pressure piping 46. High pressure channel splitter 45 as well as high pressure piping 46 are suitable for $H_2S$ service and rotate with reel 14. Lateral conduit 62 also rotates with reel 14. Wireline telemetry cable 66, which connects to service downhole tools and provide real time monitoring, controlling and data collecting, passes out of high pressure piping 46 at connector 47. Telemetry line 66, which may be a multiple line, connects with a swivel joint wireline connector 42 in a manner known in the industry.

Swivel pipe joint 50 provides a fluid connection between the high pressure non-rotating plumbing and fittings connected to the axis of working reel 14 and the rotating high pressure plumbing attached to the rotating portions of the drum, which are attached inturn to the coiled tubing on the reel. High pressure conduit 52 connects to swivel joint 50 and comprises a non-rotating plumbing connection for fluid communication with the inner coiled tubing. Valving can be provided in the rotating and/or non-rotating conduits as desired or appropriate. Conduit 52 can lead to testing and collecting equipment upon the surface related to fluid transmitted through the inner coiled tubing.

FIG. 2B offers a side view of the other side of working reel 14 from that shown in FIG. 2A. FIG. 2B illustrates plumbing applicable to the annular region between the two coils of the coiled-in-coiled tubing. Conduit 58 comprises a rotating pipe connecting with the other side of reel 14 and conduit 61 providing fluid communication through a central section 60 of the reel. Conduit or piping 58 rotates with the reel. Swivel joint 54 connects non-rotating pipe section 56 with rotating pipe 58 and provides for fluid communication with the annular region for fixed piping or conduit 56 at the surface. Piping 56 may be provided with suitable valving for controlling communication from the annular region between the two coiled tubing strings with appropriate surface equipment. Such surface equipment could comprise a source of fluid or pressurized fluid 76, indicated schematically. Such fluid could comprise gas, such as nitrogen, or water or drilling mud or some combination thereof. Monitoring means 78, also illustrated schematically, may be provided to monitor fluid within the annular region between the inner and outer coiled tubing. Monitoring equipment 78 might monitor the composition and/or the pressure of such fluid in the annular region, for example.

FIG. 2C illustrates a top cutaway view of working reel 14. FIG. 2C illustrates spool diameter 74 of working reel 14. Spool surface 75 comprises the surface upon which the coiled-in-coiled tubing is wound. Surface 75 is the surface from which the tubing is reeled and to which it is respooled. FIG. 2C illustrates wireline connector 42 connecting to wireline 66 and from which electrical line 67 is illustrated as emerging. Wireline 66 and electrical line 67 can be complex multistranded lines. Dashed line 72 illustrates the axial center of working reel 14, the axis around which working reel 14 rotates. The right side of FIG. 2C illustrates rotating plumbing or conduit 58 and non-rotating plumbing or conduit 56, both illustrated in FIG. 2B. They provide for fluid communication at the surface with the annular region between the coiled tubing strings. Conduit 61 communicates through channel 60 in working reel 14 to connect conduit 58 with lateral 62 on the far side of working reel 14. Conduit 61 and channel 60 rotate with the rotation of the drum of working reel 14. The left side of FIG. 2C illustrates rotating pipe 46 and non-rotating pipe or conduit 52. As discussed in connection with FIG. 2A, these sections of pipe or conduit provide for fluid communication between the inner coiled tubing string and surface equipment, if desired.

Split channel plumbing 45 providing lateral 62 is illustrated in cross-section more particularly in FIG. 3. Wireline 66 is shown entering plumbing fixture 45 from the left side and emerging on the right side in fluid communication channel 83. Channel 83 is in communication with the inside of the inner tubing string. Bushing 49 anchors inner tubing 102 within plumbing fixture 45. Packing and sealing means 51 prevents communication between the annular area 80, defined between outer tubing 100 and inner tubing 102, and fluid communication channel 83. Fitting 44 anchors outer coiled tubing 100 to fixture 45.

FIG. 4 illustrates in cutaway section components of coiled-in-coiled tubing. FIG. 4 illustrates cable or wireline 66 contained within inner tubing 102 contained in turn within outer tubing 100. Cable 66 could comprise fiber optic cable for some applications. Channel 82 identifies the channel of fluid communication within inner tubing 102. Annular area 80 identifies an annular region between tubings, providing for fluid communication between inner tubing 102 and outer tubing 100 if desired. A typical width for inner tubing 102 is 0.095 inches. A typical width for outer tubing 100 is 0.125 inches.

Figure 5:
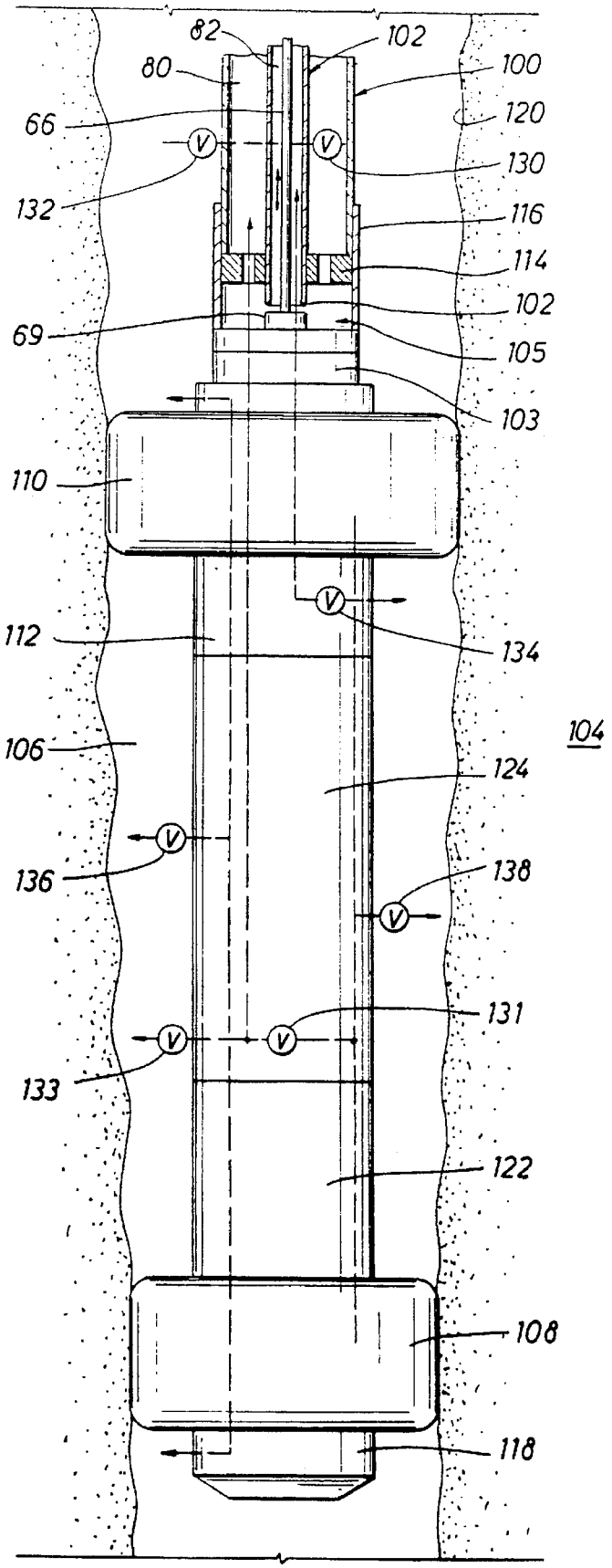
FIG. 5 illustrates an embodiment of a downhole device or tool, adapted for attachment to coiled-in-coiled tubing, and useful for controlling fluid flow between a well bore and an inner coiled tubing string as well as between the well bore and an annular region between inner and outer coiled tubing strings, and also useful for controlling fluid flow between the inner coiled tubing string and the annular region.
Figure 5:
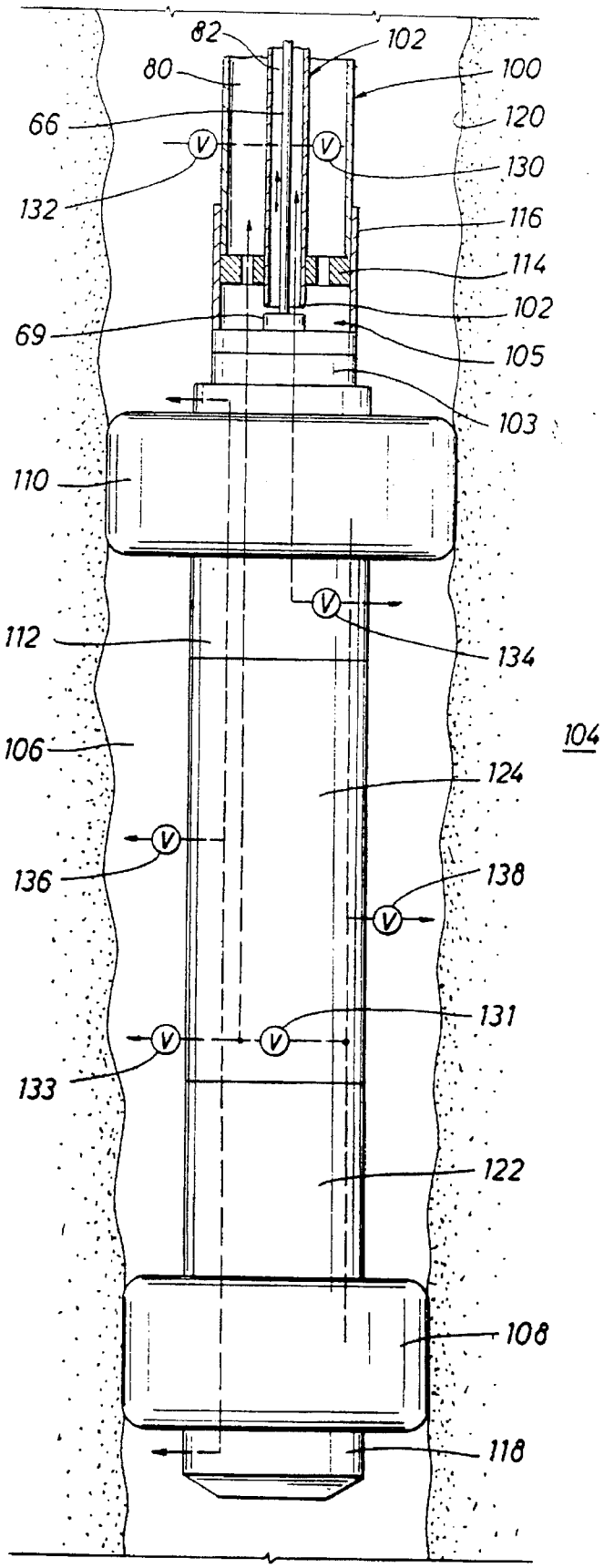

FIG. 5 illustrates an embodiment, schematically, of a downhole tool usable with coiled-in-coiled tubing, and in particular useful for drill stem testing. Tool or device 112 is attached by means of slip connector 116 to the outside of outer tubing 100. Tool 112 is shown situated in region 106 defined by borehole 120 in formation 104. Packers 108 and 110 are shown packing off between tool 112 and borehole 120 in formation 104. If formation 104 is capable of producing fluids, they will be produced through well bore 120 in the zone defined between upper packer 110 and lower packer 108. Tool bull nose 118 lies below lower packer 108.

Indicated region 122 in tool 112 refers to a general packer and tool spacer area typically incorporated within a device 112. Spacers are added to adjust the length of the tool. Provision may be made in this space, as is known in the art, to collect downhole samples for retrieval to the surface. Indicated region 124 in tool 112 refers to a general electronic section typically incorporated within a device 112. Anchor 114 anchors inner coiled tubing 102 within outer toiled tubing 100 at device 112 while continuing to provide means for fluid communication between annular region 80 between the two tubing lengths and portions of tool 112.

Valving provided by the tool is indicated stylistically in FIG. 5. Valve 130 performs the function of a circulation valve, permitting circulation between annular region 80 between the coils and fluid communication channel 82 within inner coiled tubing 102. Valve 130 could be used to circulate fluid down annular region 80 and up inner tubing channel 82, or vice versa. Wireline 66 would commonly terminate at a wireline termination fitting, illustrated as fitting 69 in tool 112. Valve 132 indicates valving to permit fluid communication between inner channel 82 and the borehole above upper packer 110. Valve 134 permits well fluids from formation 104 within borehole annular region 106 to enter into downhole tool 112 between upper packer 110 and lower packer 108 and from thence into inner tubing conduit 82. Valve 136 indicates an equalizing valve typically provided with a tool 112. Valve 131 provides for the inflation of packers 110 and 108 by fluid from annular regions 80. Valve 133 is available for injecting fluids from annular region 80 into the formation, for purposes such as to stimulate formation 104. Connector 105 between the tubing and downhole tool could contain an emergency release mechanism 103 associated therewith, as is known in the art. Valve 138 provides for deflating packers 108 and 110.

Figure 6:
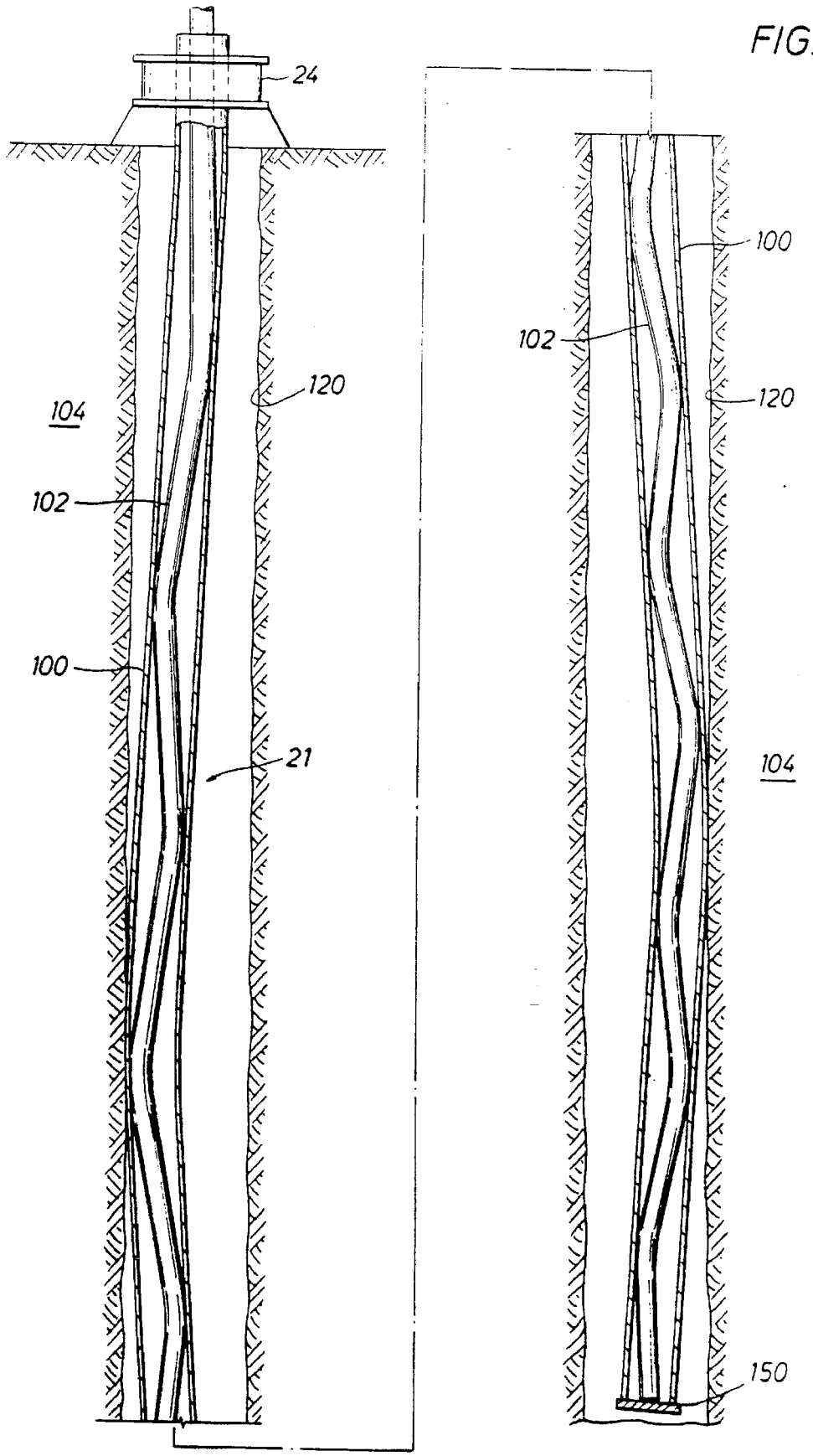
FIG. 6 illustrates helixing of an inner coil within an outer coil in "multicentric" coiled-in-coiled tubing.

FIG. 6 illustrates a helixed inner coil 102 within an outer coil 100 forming "multicentric" coiled-in-coiled tubing 21, shown strung in well 120 through formation 104. It is believed that when hung in a vertical well a coiled tubing, such as outer coil 100, would not hang completely straight. However, the weight of the coil would insure that outer coil 100 hung almost straight. Cap 150 is shown attached to the distal end of outer coil 100, downhole in well 120. Inner coil 102 is illustrated as helixed within outer coil 100. This helixing provides a lack of concentricity, or coaxiality, and is intentional. The intentional helixing provides a multicentricity for the tubes, as opposed to concentricity or coaxiality. The helixing can be affected between an inner coil 102 and an outer coil 100 and is believed will not always take the same direction. That is, the helixing might alternate between clockwise and counterclockwise directions. Inner coil 102 is illustrated in FIG. 6 as having its weight landed upon bottom cap.150 attached to outer coil 100. In this fashion, the weight of inner coil 102 is being borne by outer coil 100, illustrated as hung by a coiled tubing injector mechanism 24. Alternately, the weight of inner coil 102 could be landed on the bottom of well 120, or cap 150 could sit on the bottom of well 120, thereby relieving outer coil 100 of bearing the weight of inner coil 102.

FIG. 7 illustrates inner coiled tubing 102 spooled from spool 152 over gooseneck 154 and through inner coiled tubing injector 156 into outer coiled tubing 100. Outer coiled tubing 100 is illustrated as hung by coiled tubing injector 24 into well 120 in formation 104.

Figure 8A:
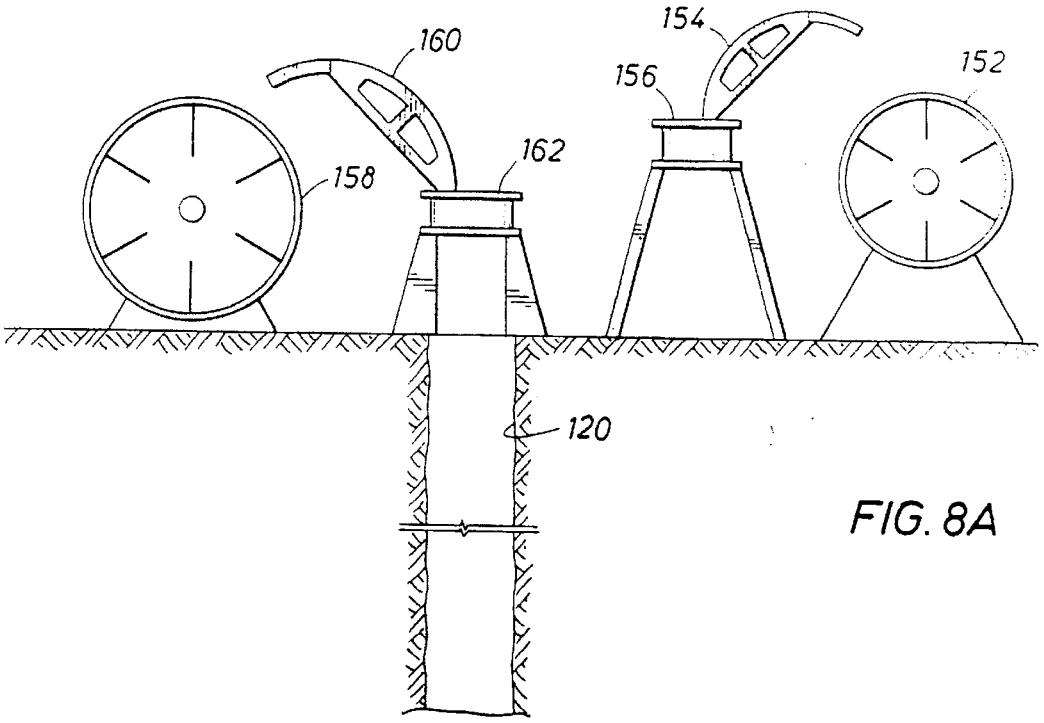
FIG. 8 illustrates a method of assembling "multicentric" coiled-in-coiled tubing.
Figure 8B:
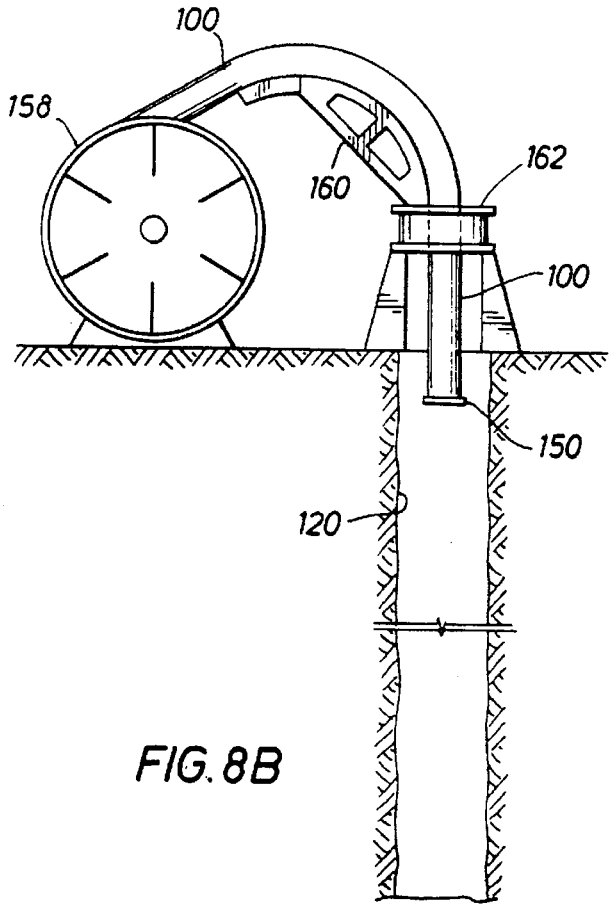
Figure 8C:
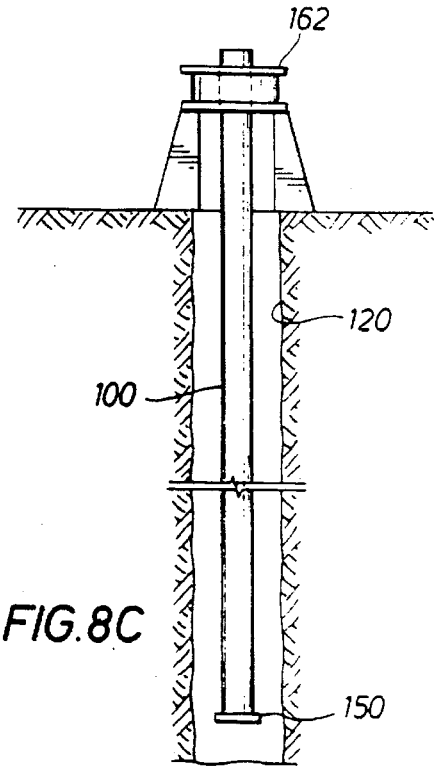

FIGS. 8A through 8F illustrate a method for assembling multicentric coiled-in-coiled tubing 21 on reel 14, as illustrated in FIG. 8G. FIG. 8A illustrates spool 152 holding inner coiled tubing 102 sitting beside well 120. With spool 152 is inner coiled tubing injector 156 and inner coiled tubing gooseneck support 154. Also at well site 120 is outer coiled tubing spool 158, outer coiled tubing injector 162 and outer coiled tubing gooseneck 160. FIG. 8B illustrates outer coil 100 being injected by coiled tubing injector 162 into well 120 from spool 158 and passing of a gooseneck 160. FIG. 8C illustrates outer coiled tubing 100 hung by outer coiled tubing injector 162 over well 120. Gooseneck 160 and spool 158 have been removed. Outer coiled tubing 100 is shown having cap 150 affixed to its distal or downhole end. FIG. 8D illustrates inner coiled tubing 102, injected and helixed into outer coil 100 hung in well 120. Inner coil 102 is injected from spool 152 over gooseneck 154 and by injector 156. The bottom of inner coil 102 is shown resting upon cap 150 at the downhole end of outer coil 100, hung in well 120 by outer coil injector 162. FIG. 8E illustrates inner coil 102 being allowed to relax and to sink, to helix and to spiral further, inside outer coiled tubing 100 hung by injector 162 in well 120. FIG. 8F illustrates respooling coiled-in-coiled tubing 21 onto working reel 14 using outer coiled tubing injector 162 and outer coiled tubing gooseneck 160. Outer tubing 100 has been connected to reel 14. If separate means for hanging outer tubing 100 are provided, the operation can be carried out with one coiled tubing injector and one gooseneck.

In operation, the safeguarded method of the present invention for the communication of fluid from within a well is practiced with coiled tubing carried on a spool. The method is practiced by attaching a distal end of coiled-in-coiled tubing from a spool to a device for controlling fluid communication. The device, anticipated to be a specialized tool for the purpose, will be inserted into a well. (The safeguarded method for fluid communication would also, of course, be effective on the surface. Safeguarded communication from within a well offers the difficult problem to solve.)

Coiled-in-coiled tubing comprises a first coiled tubing length situated within a second coiled tubing length. A first channel for fluid communication is defined by the inside tubing length. The device or tool attached at the distal end of the coiled-in-coiled tubing controls fluid communication through this first inner communication channel. The device may also control some fluid communication possibilities through an annular region as well. An annular region is defined between the first inner coiled tubing length and the second outer coiled tubing length. Fluid communication is also to be controlled, at least to a limited extent, within this annular region. At the least, such control should extend to sealing off the annular region to provide the margin of safety in the case of leaks in the inner tubing. Preferably, such control would include a capacity to monitor the fluid status, such as fluid composition and/or fluid pressure, within such region, for leaks. Preferably such control would include a capacity to pressurize a selected fluid within the annular region, to more speedily detect leaks. In preferred embodiments, the annular region may also function as a second fluid communication channel.

The coiled-in-coiled tubing is injected from a spool into the well. Primary fluid is communicated through the inside tubing length from the well to the spool. Of course, fluid could also be communicated in a safeguarded manner from the spool to the well, if such need arose. The primary fluid may remain contained within the inside tubing length, as in a closed chamber, to minimize risk. Alternately the fluid may be communicated from the inside tubing length through a swivel joint located upon the spool to other equipment and/or surface containers. The coiled-in-coiled tubing is eventually respooled.

The device for controlling fluid communication through the inside tubing length usually comprises a specialized tool developed for multiple purposes, fitted to operate in conjunction with coiled-in-coiled tubing. The tool may communicate electronically through a wireline, probably multistrand, run through the inside tubing. The tool may also collect one or more samples of fluid and physically carry the samples upon respooling, to the surface. The tool may further contain means for measuring pressure.

The annular region between the inside and the outside coiled tubing provides the safeguard, the secondary protective barrier in case of leaks in the inside tubing, for the present method for fluid communication. For that reason, as mentioned above, fluid in the annular region should at least be controlled in the sense that control comprises sealing off the annular region. As discussed above, preferably, the control includes monitoring fluid status within the annular region, such as fluid composition and/or fluid pressure, and may include supplying pressurized fluid to the annular region, such as pressurized water, inert gas or nitrogen, drilling mud, or any combination thereof. The pressure of such monitoring fluid can be monitored to indicate leaks in either of the coiled tubing walls. Overpressuring the annular region would ensure that a leak in either the inner tubing wall or the outer tubing wall would result in annular fluid evacuating the annular region and invading the inner tubing string or the outside of the coiled-in-coiled tubing. Such overpressurization in particular guards against potentially hazardous fluid from inside the inner tubing ever entering the annular region.

Upon the indication of a leak in either coiled tubing wall, the primary fluid communication in the inner tubing could be terminated. The well may also be shut in by closing the valve and/or the well may be killed by deflating the packers. A blowout preventor (BOP) could be activated, if necessary.

The present safeguarded method for fluid communication is applicable to work within a wellbore as well as in a cased well or well tubing. Such wellbore, cased well or well tubing may itself be filled with fluid, such as static drilling fluid.

The device or tool for controlling fluid communication from the well frequently includes a packer or packers for isolating a zone of interest. The annular region between the tubing walls can be used as a fluid communication channel for supplying fluid to inflate the packers. The annular region could also be used as a fluid communication channel for supplying a stimulating fluid, such as acid, or a lifting fluid such as nitrogen, downhole to the well.

The coiled-in-coiled tubing is attached at the surface to a working reel or spool. The spool for coiled-in-coiled tubing will contain means for splitting the fluid communication channel originally from within the inner coiled tubing from the potential communication channel defined by the annular region between the coiled tubing lengths. Generally speaking, the inside length also should be no longer than 1% of the outside length.

One aspect of the present invention provides improved apparatus for practicing above the method, the improved apparatus comprising "multicentric" coiled-in-coiled tubing. Such multicentric coiled-in-coiled tubing includes several hundred feet of continuous thrustable tubing, coiled on a truckable spool. The tubing includes a first length of coiled tubing of at least ½ inch outside diameter helixed within a second length of coiled tubing. Generally speaking, taking into account the variations possible between OD's of inside and outside tubing and wall thickness, when measured coextensively the first inside length would be at least 0.01% longer than the second outside length. Generally speaking, the inside length also should be no longer than 1% of the outside length. (It is of course clear, that either the inside length or the outside length could be extended beyond the other at either the spool end or at the downhole end. "Measuring coextensively" is used to indicate that such extension of one length beyond the other at either end is not intended to be taken into account when comparing lengths.)

When coiled-in-coiled tubing is spooled, it is believed that the inner length, to the extent it overcomes friction, would tend to spool at the maximum possible spool diameter. That is, the inner length would tend to spool against the outer inside surface of the outer length. Such tendency, if achieved, would result in a significantly longer length for the inside tubing versus the outside tubing. The difference in length is significant because the present inventors anticipate that if the coiled-in-coiled tubing were allowed to assume this maximum spool diameter position on the spool and the ends were fixed to each other, then when straightened, the inner tubing would tend to fail or buckle within the outer tubing.

"Concentric" or "coaxial" tubing comprises, of course, strands of the same length. Centralizers could be used to maintain an inner tubing concentric or coaxial within an outer tubing on a spool. Alternately, an inner tubing could be inserted coaxially in a straightened position within an outer tubing, and the two ends of the two tubings could then be affixed together to prevent retreat of the inner tubing within the outer tubing upon spooling. For instance, an inner coiled tube could be injected within an outer coiled tube hung in a vertical well, possibly using means to minimize friction therebetween, such that, measured coextensively, the lengths of both coils would tend to hang straight and be very close to the same length. The inner coil would not be helixed within the outer coil. To help straighten out any undesired helixing, the inner coil could latch on to a cap attached to the bottom of the hung outer coil. The weight of the outer coil could then be picked up and carried by the inner coil if the inner coil were lifted subsequent to latching onto the end cap. So lifting the inner coil, bearing not only its own weight but part or all of the weight of the outer coil would help straighten the inner coil out within the outer coil and align the two coils. This solution, "coaxial" or "concentric" coils is believed not to be optional. Coaxiality might result in an unacceptable level of compression and/or tension being placed upon on portions of one and/or the other length while resting on the spool.

It is proposed by the present inventors that the "multicentric" coiled-in-coiled tubing disclosed herein best solves the above problems without involving the complexity of centralizers. Helixing the inner coil within the outer coil provides an advantageous amount of frictional contact between the two coils, frictional contact that is dispersed relatively uniformly. Furthermore, the inner coil has a certain amount of flexibility in which to adjust its configuration longitudinally upon spooling in and out. The helixed inner coil should not buckle or fail upon respooling and spooling. The frictional contact should be sufficient between the helixed inner coil and outer coil that unacceptably high areas of compression or tension between the two coils are not created while on the spool. The helixed inner coil, under certain circumstances, may even enhance the structural strength of the coiled-in-coiled tubing as a whole.

The foregoing disclosure and description of the invention are illustrative and explanatory thereof. Various changes in the size, shape and materials as well as the details of the illustrated construction may be made without departing from the spirit of the invention.

What is claimed is:

1. A safeguarded method for fluid communication within wells, comprising:

attaching coiled-in-coiled tubing, comprising a first coiled tubing length helixed within a second coiled tubing length, to a device for controlling fluid communication within said inside tubing;

injecting said coiled-in-coiled tubing and device from a spool into a well;

controlling fluid communication within an annular region defined between said first and said second tubing lengths;

controllably communicating fluid from said well through said inside tubing length; and respooling said coiled-in-coiled tubing.

2. The method of claim 1 that includes monitoring fluid status within said annular region.

3. The method of claim 1 that includes packing off a well annulus portion around said tubing/device combination above a production zone.

4. The method of claim 2 that includes filling said annular region with monitoring fluid.

5. The method of claim 1 that includes filling said annular region with water.

6. The method of claim 1 that includes filling said annular region with drilling mud.

7. The method of claim 1 that includes filling said annular region with nitrogen.

8. The method of claim 4 wherein said monitoring includes pressurizing said monitoring fluid and monitoring said fluid pressure.

9. The method of claim 2 wherein said monitoring includes monitoring fluid composition within said annular region.

10. The method of claim 2 that includes terminating fluid communication upon an indication of an annular region fluid leak.

11. The method of claim 10 wherein said terminating fluid communication includes killing said well.

12. The method of claim 1 wherein said injecting comprises injecting into a wellbore.

13. The method of claim 1 wherein said injecting comprises injecting into a cased well.

14. The method of claim 1 wherein said injecting comprises injecting into a well tubing.

15. The method of claim 1 wherein said injecting comprises injecting into a well filled with fluid.

16. The method of claim 15 wherein said well fluid comprises drilling fluid.

17. The method of claim 15 wherein said well fluid comprises static fluid.

18. The method of claim 3 that includes a second packing off within a well annulus portion below said zone.

19. The method of claim 18 wherein said first and said second packing off include setting inflatable packers and that further includes deflating said inflatable packers.

20. The method of claim 1 wherein said controllably communicating fluid includes producing sour gas.

21. The method of claim 1 wherein said controllably communicating fluid includes producing oil.

22. The method of claim 1 wherein said controllably communicating fluid includes producing gas.

23. The method of claim 3 wherein said packing off includes inflating a packer with an inflating fluid supplied through said coiled-in-coiled tubing.

24. The method of claim 1 that includes running a cable within said first inside coiled tubing length and transmitting signals over said cable.

25. The method of claim 1 that includes attaching a reservoir pressure measuring tool to said coiled-in-coiled tubing proximate said fluid control device.

26. The method of claim 1 that includes measuring fluid produced through said inside tubing.

27. The method of claim 1 that includes splitting out at said spool a first fluid communication channel defined by said first inside coiled tubing length from a second fluid communication channel defined by said annular region.

28. The method of claim 23 that includes supplying said inflating fluid through said annular region.

29. The method of claim 3 that includes supplying stimulating fluid to said zone through said annular region.

30. The method of claim 3 that includes securing a sample of production fluid from said zone and respooling said sample with said coiled-in-coiled tubing.

31. Multicentric coiled-in-coiled tubing, comprising:

several hundred feet of continuous thrustable tubing, coiled on a truckable spool, said tubing comprising a first length of coiled tubing having at least ½ inch OD helixed within a second length of coiled tubing, and wherein, measured coextensively, said first inside length is at least 0.01% longer than said second outside length.

32. The tubing of claim 31 wherein said first inside length, measured coextensively, is no longer than approximately 1% of said outside second length.

33. The tubing of claim 31 wherein said first inside length coils on said spool at an average spool diameter that is more than said second outside length spool diameter when said first and second spool diameters are defined by the neutral axes of the said first and second tubing lengths.

34. The tubing of claim 31 wherein the OD of said first length comprises at least 30% of the OD of said second length.

35. The tubing of claim 31 wherein said first inner length has an outside diameter of between ½ inch and 5 inches and said second outer length has an outside diameter of between 1 inch and 6 inches.

36. The tubing of claim 31 wherein a radial distance between said first tubing and said second tubing, measured from outside tube ID to inside tube OD, ranges from between approximately ¼ inch to 1 inch.

37. The tubing of claim 31 wherein said inside tubing length contains titanium.

38. The tubing of claim 31 wherein said inside tubing length comprises steel having a hardness of less than 22 on the Rockwell C scale.

39. The tubing of claim 31 wherein said inside tubing length comprises a fiber and resin composite.

40. The tubing of claim 31 wherein said outside tubing length comprises a fiber and resin composite.

41. The tubing of claim 31 wherein said inside tubing length comprises a corrosion resistant alloy.

42. A method for assembling a multicentric coiled-in-coiled tubing, comprising hanging a second coiled tubing length in a vertical well;

helixing a first coiled tubing length, having an OD of at least 30% of the OD of said second length, into said hung second length such that, measured coextensively, said inner tubing length is approximately 0.01% to 1% longer than said outer tubing length;

attaching said outer length to a spool; and spooling said outer length containing said inner length upon said spool.

43. The method of claim 42 that includes injecting said second length into said well and injecting said first length into said second length using coiled tubing injection.

44. The method of claim 42 that includes landing at least a portion of said inner tubing length weight upon an inner tubing length downhole end.

45. The method of claim 42 that includes landing at least a portion of said inner tubing length weight on a downhole portion of said outer tubing length.

46. The method of claim 42 that includes attaching an end of said inner tubing length to said spool.

* * * * *